United States Patent [19]
Corrigan, Jr. et al.
[11] 4,402,417
[45] Sep. 6, 1983

[54] BOTTLE OPENING RING HAVING SHOCK ABSORBING MEANS

[75] Inventors: William C. Corrigan, Jr., Mundelein; Thomas A. Fowles, McHenry, both of Ill.; Nicholas Gibbons, Thetford, England

[73] Assignee: Baxter Travenol Laboratories, Inc., Deerfield, Ill.

[21] Appl. No.: 335,113

[22] Filed: Dec. 28, 1981

[51] Int. Cl.³ ..... B65D 41/34
[52] U.S. Cl. ..... 215/232; 215/253
[58] Field of Search ..... 215/32, 232, 250, 253

[56] References Cited

U.S. PATENT DOCUMENTS

| | | | |
|---|---|---|---|
| 3,923,179 | 12/1975 | Choksi et al. | 215/251 X |
| 4,093,093 | 6/1978 | Fowles et al. | 215/251 |
| 4,096,962 | 6/1978 | Riuli et al. | 215/32 |
| 4,101,041 | 7/1978 | Mauro et al. | 215/32 X |
| 4,111,325 | 9/1978 | Bellamy et al. | 215/232 |
| 4,176,755 | 12/1979 | Winchell | 215/32 |
| 4,181,232 | 1/1980 | Bellamy et al. | 215/232 |

FOREIGN PATENT DOCUMENTS

| | | | |
|---|---|---|---|
| 751167 | 11/1970 | Belgium | 215/32 |
| 2080775 | 2/1982 | United Kingdom . | |

*Primary Examiner*—Donald F. Norton
*Attorney, Agent, or Firm*—Paul C. Flattery; John P. Kirby, Jr.; Bradford R. L. Price

[57] ABSTRACT

An opening ring (40) for a bottle (29) has a closure element (36) attached to the bottle neck (30) at a frangible section (38). The opening ring (40) includes rigid shock absorbing means such as a collar (58) to protect the bottle from unwanted opening of the frangible section (38) which would thereby destroy the seal, and in the case of bottle-stored sterile liquids, contaminate same.

2 Claims, 4 Drawing Figures

FIG. 1 - PRIOR ART
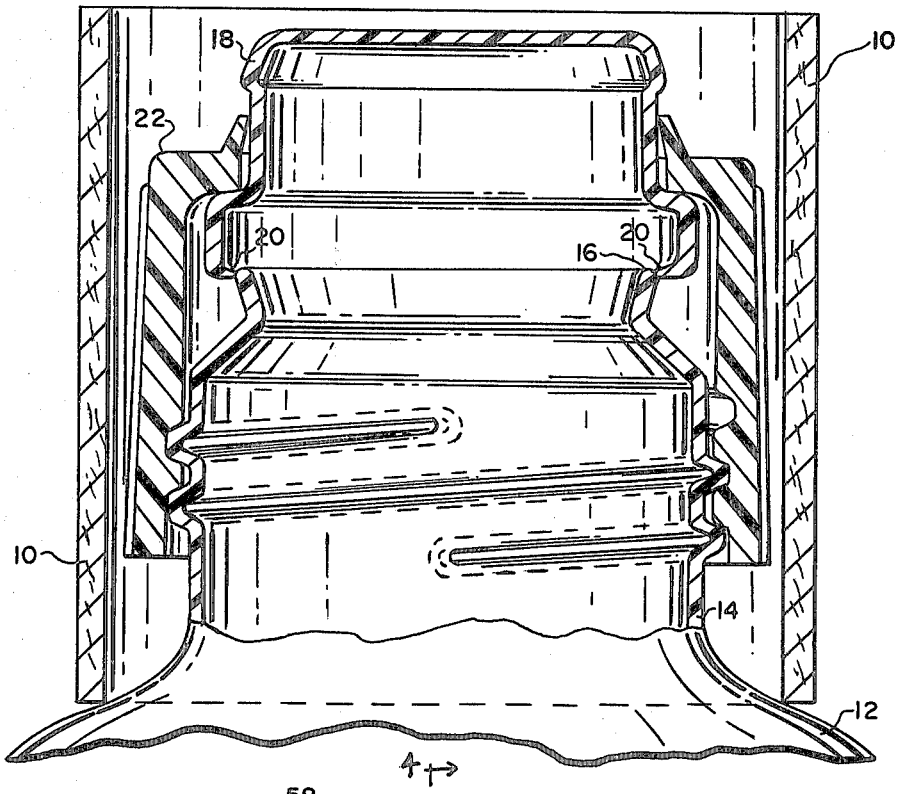
FIG. 2
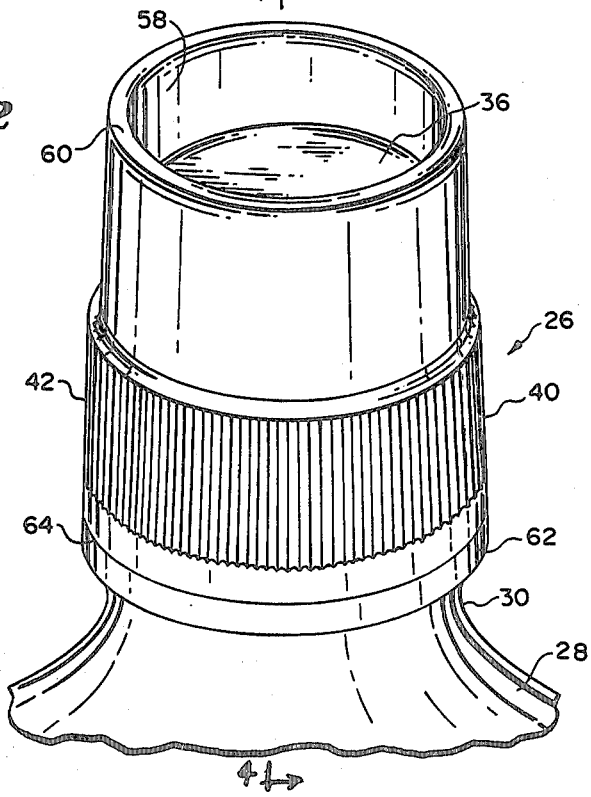

BOTTLE OPENING RING HAVING SHOCK ABSORBING MEANS

TECHNICAL FIELD

The present invention relates to bottle closures and in particular to an opening ring for a blowmolded bottle hermetically sealed at a frangible break-apart line of weakness, the opening ring inhibiting accidental fracture of the frangible seal.

BACKGROUND OF THE INVENTION

Known in the prior art are containers formed in a one-piece molded construction in which the container closure is coupled to the container neck by means of a frangible section. In order to permit removal of the contents from a container the closure is severed from the neck at the frangible section and the closure is removed.

Such containers are of great benefit in the medical field because they permit the low cost packaging of liquids in which sterility is necessary. Such containers are often manufactured in a streamlined operation that includes forming the container, filling the container with the sterile liquid, and sealing the container with a closure element fused to the bottle outlet. Such a seal forms a frangible line of weakness.

Most often, the means employed to open such a bottle includes an outer ring which includes internal threads which threadedly cooperate with external threads disposed on the neck of the bottle. Usually, a projection of some sort extends inwardly of the outer ring to engage part of the closure element. An example of such a system is seen in U.S. Pat. No. 4,176,755, assigned to the assignee of the present invention. To open the container, the outer ring is rotated either downwardly or upwardly depending on the design, to engage the closure element and break the frangible line of weakness.

Baxter Travenol Laboratories, Inc. of Deerfield, Ill., the present assignee, has found in its business that such containers, while highly successful, present a problem: the frangible line of weakness which enables the closure system to work is also susceptible to opening by unwanted forces during shipping and handling. As seen in FIG. 1 of the drawings, illustrating the prior art, a bottle 12 has a neck portion 14 defining an outlet 16. A closure element 18 is fused to the neck portion 14 at a line of weakness 20. A ring 22 is placed about the neck portion 14. The closure element 18 is indeed an easy target for receiving unintentionally applied forces occurring from the time of manufacture, including during shipping and in-hospital handling where the product is used. In an attempt to solve this problem, heavy cardboard cylinders 10 are manually placed over the neck and outer ring of the container for shipping. This procedure is expensive due both to the substantial cost of the cardboard cylinders and the cost of applying the cylinders to the containers. Also, the cardboard cylinders are useful only during shipping. They do not protect the frangible section 20 once the bottles are unpacked in the hospital.

The present invention is directed to an opening ring and closure system which protects the closure element from unintended opening during shipping and handling while eliminating the need for any additional piece, such as a cardboard packing cylinder. The apparatus of the present invention, unlike the packing cylinder, continues to protect the container seal in the hospital after the bottles have been unpacked.

SUMMARY OF THE INVENTION

The apparatus of the present invention includes a unique opening ring which is of low cost and is easy to mold and manufacture. The cost of extra packing materials is eliminated. Less labor is needed in preparing the product for shipping. This seal of the container is protected even in the hospital from unintended forces which might otherwise destroy the seal and contaminate the sterile contents of the container.

The apparatus of the invention includes an opening ring which includes rigid shock absorbing means extending upwardly from the sidewall of the opening ring. In the preferred embodiment the shock absorbing means includes a collar extending upwardly from the sidewall of the opening ring. The top portion of the shock absorbing means is disposed higher than both the closure element of the bottle and the closure element engagement means, thereby protecting the frangible line of weakness from accidentally applied forces and keeping the seal intact. In the preferred embodiment of the invention, the container includes a horizontal step on the neck of the container which abuts the bottom edge of the opening ring. Forces applied to the shock absorbing means are transmitted through the horizontal step to the bottle, exclusive of the closure element.

DESCRIPTION OF THE DRAWINGS

FIG. 1 is a fragmentary cross-sectional view of an example of the prior art.

FIG. 2 is a fragmentary perspective view of the new closure system of our invention.

DETAILED DESCRIPTION OF THE PREFERRED EMBODIMENT

Figure 3:
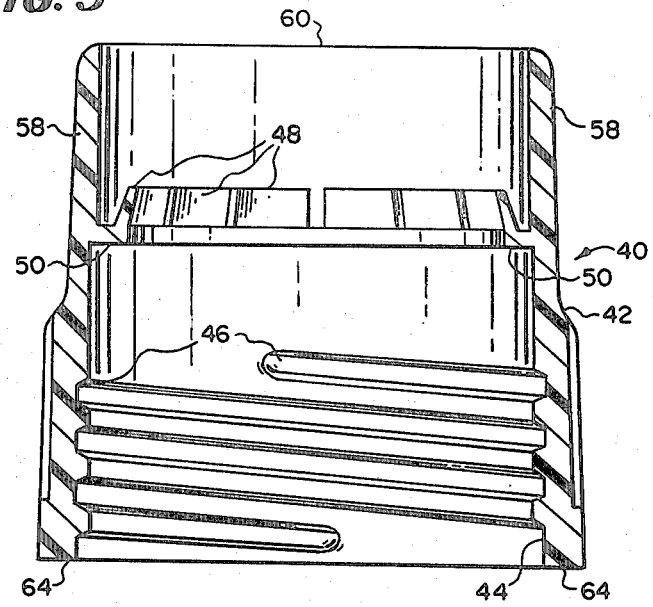
FIG. 3 is a cross-sectional view of the opening ring of the present invention.
Figure 4:
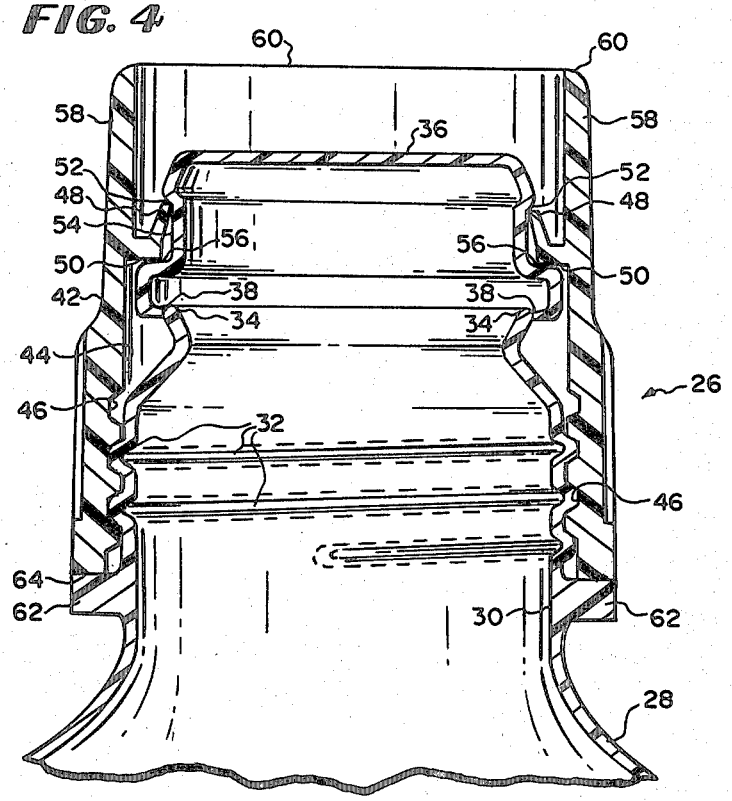
FIG. 4 is a cross-sectional view taken at line 4—4 in FIG. 2.

FIGS. 2, 3 and 4 illustrate the closure system 26 of the present invention. A bottle 28 or other container includes a plastic neck portion 30. Neck threads 32 are disposed on the neck portion 30. The neck portion 30 defines an outlet 34. After the bottle 28 is formed and filled with the liquid to be stored (not shown), a plastic closure element 36 is fused to the neck portion 30 at a frangible line of weakness 38. The new opening ring 40 of the present invention is mounted on the bottle 28 as seen in FIGS. 2 and 4.

The opening ring 40 includes a sidewall 42 which defines an opening 44 such that the opening ring 40 is carried about the neck portion 30. The sidewall 42 includes internal threads 46 thereon for threadedly mounting the opening ring 40 about the neck portion 30 in cooperation with the neck threads 32 to form a bottle engagement means.

The opening ring 40 includes closure element engagement means for breaking the frangible line of weakness 38 and opening the container. The closure element engagement means may include a plurality of fingers 48 extending upwardly and inwardly from the sidewall 42. Alternatively, the closure element engagement means may include a bearing surface 50 extending inwardly from the sidewall 40. The closure system 26 may break the frangible line of weakness 38 by rotation of the opening ring 40 in either an upward or downward direction depending on the particular design chosen and governed by placement of the cooperating threads. If in the upward direction, the fingers 48 will engage the top surface 52 of an annular recess 54 in the closure element 36 to break the line of weakness 38. If designed to open in the downward direction, the bearing surface 50 will engage the bottom surface 56 of the annular recess 54. The closure system 26 shown in FIGS. 2 through 4 is designed for breaking the frangible line of weakness 38 upon rotation of the opening ring 40 in the upward direction. Thus bearing surface 50 does not engage the bottom surface 56.

The opening ring 40 of the present invention includes rigid shock absorbing means such as a collar 58 extending upwardly from the sidewall 42. The top portion 60 of the collar 58 is disposed higher than both the outlet sealing closure element 36 and the fingers 48.

In the preferred embodiment shown, the bottle engagement means includes, in addition to the threads 32, 46, a horizontal step 62 extending outwardly from the neck portion 30. A bottom edge 64 of the opening ring 40 abuts the horizontal step 62 when the opening ring is mounted on the bottle 28, thereby limiting further downward movement of the opening ring 40. Thus, even inadvertent downward rotation of the opening ring 40 which would displace the selected placement of the collar 58 is prevented.

The opening ring 40 protects the frangible line of weakness 38 from unintended fracture because blows otherwise received by the closure element 36 are now received by the rigid shock absorbing means such as the collar 58. The force from the blow is transmitted from the rigid shock absorbing means through the bottle engagement means such as the threads 32, 46 and/or the horizontal step 62 to the bottle 28, exclusive of the closure element 36, thereby keeping the frangible line of weakness 38 intact.

While one embodiment of the present invention has been described in detail and shown in the accompanying drawings, it will be evident that various modifications are possible without departing from the scope of the present invention.

What is claimed is:

1. In an opening ring for a bottle having an externally threaded neck portion defining an outlet and sealed by a closure element fused to the neck portion to form a frangible, break-apart line of weakness, said opening ring including a sidewall defining an opening having internal threads thereon for engagement with the external threads on the neck portion such that said opening ring may be threadedly mounted about the neck portion, and closure element engagement means extending from said sidewall for breaking the frangible line of weakness upon rotating said opening ring to effect vertical movement of said closure element engagement means relative to the closure element, the improvement comprising:

a rigid collar extending upwardly from said sidewall;

said collar including an open top portion which is disposed higher than the outlet-sealing closure element and the closure element engagement means; and a bottom edge of said sidewall which abuts an associated horizontal step on the bottle, thereby preventing inadvertent downward displacement of said collar relative to the closure element which would otherwise cause the closure element engagement means to break the frangible line of weakness;

wherein said collar, including said top portion, protects the closure element from accidental blows which would otherwise force the closure element to break apart from the neck portion at the line of weakness, the force of any blow to said collar being transmitted to the bottle through at least one of the horizontal step and the threads.

2. The opening ring as in 1 wherein the closure element includes an annular recess having a top surface and a bottom surface and the closure engagement means comprises a plurality of fingers extending upwardly and inwardly from said sidewall to engage one of the top and bottom surfaces to break the frangible line of weakness.

* * * * *